United States Patent [19]

Nelsson

[11] 3,986,313

[45] Oct. 19, 1976

[54] RELEASIBLY LOCKING DEMOUNTABLE PARTITIONS AND STUDS

[75] Inventor: Nels Nelsson, Des Plaines, Ill.

[73] Assignee: United States Gypsum Company, Chicago, Ill. 60606

[22] Filed: June 17, 1975

[21] Appl. No.: 587,586

Related U.S. Application Data

[63] Continuation of Ser. No. 475,734, June 3, 1974, abandoned, which is a continuation of Ser. No. 288,197, Sept. 11, 1972, abandoned.

[52] U.S. Cl. ..... 52/481; 52/241; 52/496

[51] Int. Cl.[2] ..... E04B 2/78

[58] Field of Search ..... 52/493, 481, 496, 241, 52/238

[56] References Cited

UNITED STATES PATENTS

| | | | |
|---|---|---|---|
| 2,662,745 | 12/1953 | Jorn | 52/493 |
| 3,349,529 | 10/1967 | Byssing | 52/481 |
| 3,429,090 | 2/1969 | Metelnick | 52/481 |
| 3,499,251 | 3/1970 | Sandmann | 52/481 |
| 3,683,575 | 8/1972 | Meziere | 52/241 |
| 3,714,753 | 2/1973 | Jahn | 52/496 |
| 3,731,447 | 5/1973 | Dawdy | 52/481 |
| 3,759,001 | 9/1973 | Judkins | 52/241 |

FOREIGN PATENTS OR APPLICATIONS

| | | | |
|---|---|---|---|
| 511,174 | 5/1952 | Belgium | 52/481 |

*Primary Examiner*—John E. Murtagh
*Attorney, Agent, or Firm*—Samuel Kurlandsky; Donnie Rudd; Robert H. Robinson

[57] ABSTRACT

A releasibly locking, accessible and demountable partition assembly featuring kerfed panels, stud members, and means for releasibly locking at least one panel to each stud member, the means including angle members and vertically-extending means on the stud permitting engagement and disengagement of the angle members anywhere along the height of the stud member.

8 Claims, 10 Drawing Figures

RELEASIBLY LOCKING DEMOUNTABLE PARTITIONS AND STUDS

This is a continuation of application Ser. No. 475,734, filed June 3, 1974, now abandoned which itself is a continuation application of U.S. Pat. application Ser. No. 288,197, now abandoned, filed on Sept. 11, 1972.

BACKGROUND OF THE INVENTION

Demountable partition assemblies have become of primary importance in large building projects, wherein hollow walls of less than permanent construction are required which are easily assembled and later disassembled. Disassembly is necessary if wall locations are to be altered, such as in the redesign of office layouts. Such assembly and disassembly generally requires, for practicality, a minimum of relatively uncomplicated components. The hollow wall thus ideally constructed is generally characterized by partition members, primarily made from gypsum wallboard or panels, which are positioned adjacent to each other in two parallel spaced-apart opposing rows defining the sides of the wall. The spaced-apart opposing relationship of the sides is accomplished by studs of metal or wood to form the interior of the wall or divider wherein plumbing and electrical conduits are positioned. For maximum esthetic appeal, the studs do not project outwardly from between the panels, but engage kerfs in the panels' edges.

In my copending U.S. Pat. application Ser. No. 77,997, filed Oct. 5, 1970, now U.S. Pat. No. 3,732,657, there is described a demountable partition formed by two opposed rows of panels, and studs, wherein each row is independently mounted from, but yet laterally supported by, the opposite row. Individually accessible panels are provided through the use of studs having a cross-sectional shape generally in the form of a C, which permits each stud to interengage with only one panel. A pair of such studs positioned back-to-back permits an individual panel and its stud to be demounted without distrubing the remainder of the wall or partition.

That partition assembly has provided great flexibility and esthetic design through the use of a minimum number of parts and studs. However, because adjacent C studs usually are mounted independently of each other, it is possible to inwardly displace one of the adjacent panels so mounted with respect to the other, and not have it "bounce" back to be coplanar with the adjacent panel, creating what is known as "lipping". It is thus desirable to provide a partition assembly which retains the individual accessibility of panels while at the same time maintains a fixed relationship betwen adjacent panels in a row.

Building constructions have been provided in the past which provide two support members which are to mate together, one being attached to one of a pair of adjacent wall units and the other to the other in the pair of wall units. The mating has been accomplished by tongues in one of the support members which project into holes or grooves in the mating support member. An example is shown in U.S. Pat. No. 2,010,848. The difficulty with such constructions has been that the tongues must line up exactly with the openings in the mating member, a feat which is difficult to do when the partition panels are preassembled, as is usually the case, to the support member and both are then assembled to the already standing matable support member. That is, the to-be-erected panel prevents the worker from seeing the location of the mating openings. Still another disadvantage is the fact that errors in dimensions and location of the openings in the one support member during manufacturing cannot be tolerated, or alternatively, so much leeway must be built in to avoid dimensional errors that the entire assembly has a sloppy, loose fit.

SUMMARY OF THE INVENTION

The invention relates to a demountable partition assembly or wall comprising stud or support members and partition panels, wherein at least some of the panels are releasibly locked to the stud member in a manner which prevents lipping and which is not especially limited by dimensional tolerances of the support member. More specifically, there is provided an improved demountable partition assembly and support members incorporated therein, including stud members having a web portion, and two opposed, spaced apart rows of adjacent partition panels having kerfed vertical edges, each pair of adjacent edges defining a joint with a stud member positioned in the vicinity of each joint, and means releasibly engaging the stud member with the kerfed edge of at least one of the adjacent panels in one of the rows. The improvement features the engaging means including at least one angle member defined by a kerf-engaging leg and a second leg, and at least one flange projecting from one side of said web portion of define a vertical slot between the flange and the web portion opening outwardly towards the joint, the flange and the second leg being characterized by a socket defined by one and a beaded vertical edge defined by the other, the beaded edge being especially adapted to releasibly snap into the socket; whereby the angle-engaging panel may be demounted from the assembly without disturbing the stud member, the adjacent panel, or the panels of the opposite row. The beaded edge may either be the vertical edge of the second leg or the terminal edge of the flange.

Accordingly, it is an object of the invention to provide a releasibly locking support member for kerfed panels and a demountable partition assembly incorporating the same wherein adjacent panels are positively stopped from being depressed out of coplanar alignment with each other, known as lipping.

It is another object of the invention to provide such a support member and assembly wherein the members which are releasibly locked are so engaged anywhere along the full height of the support member, eliminating the need for careful alignment of the members during assembly.

Yet another object of the invention is to provide such a support member and assembly wherein accidental unlocking or disengagement is prevented, while still permitting deliberate demounting of individual panels.

Still another object of the invention is to provide such a support member and assembly wherein the need for careful tolerances is eliminated.

A related object of the invention is to provide such an assembly and support member therefor which are relatively easy to assemble.

Other objects and advantages will become apparent upon reference to the following description of the drawings and of the preferred embodiments.

DESCRIPTION OF THE PREFERRED EMBODIMENTS

The disclosure concerns a demountable partition assembly featuring two opposed rows of partition panels and stud members mounted at the vicinity of the joints formed by adjacent panels in each row. Any type of wall can be constructed in this manner, but preferably at least one of each pair of adjacent panels is provided with individual accessibility, the stud members being further characterized by lateral support provided for the opposite row of panels in the assembly.

Figure 1:
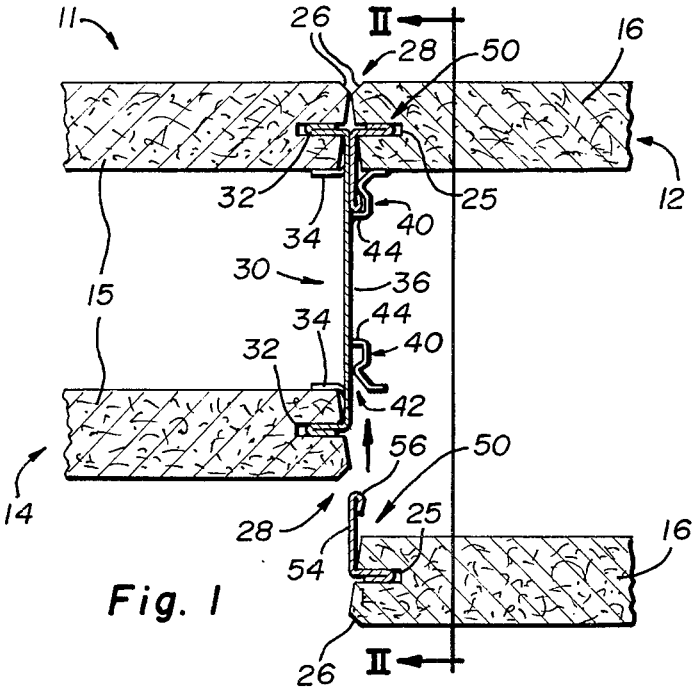
FIG. 1 is a fragmentary plan view in section, illustrating the assembly of a wall constructed in accordance with the invention.
Figure 2:
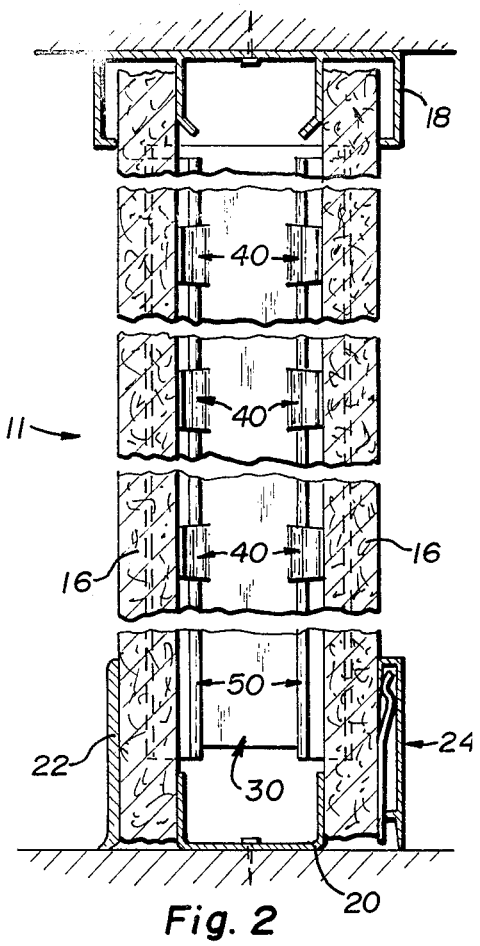
FIG. 2 is a fragmentary sectional view taken generally along the line II—II of FIG. 1, illustrating the wall in its completely assembled form.

Thus, as in FIGS. 1 and 2, a wall or partition assembly 11 can be assembled with partition panels 15 and 16 spaced apart in two opposed rows 12 and 14, each row supported by a stud member 30. The stud members are preferably floating, the entire wall being conventionally mounted by ceiling and floor runners 18 and 20, respectively (FIG. 2). That is, the floor edges of the partition may be finished with either a "top set" base 22 or a base and attachment clip 24. The panels 16 may be of any conventional material, preferably gypsum wallboard, and at least the panels 16 of row 14 are kerfed at 25 along their vertical edges 26. Adjacent panels in either row 12 or 14, when taken in pairs, define by their adjacent kerfed vertical edges, joints 28. Each support member mounts at least one panel of at least one row in the vicinity of a joint. Specifically, as shown in FIG. 1, panels 15 are interengaged by flanges 32 and backup tabs 34 integrally extending from opposite edges of a stud member 30, in a conventional manner, such mounting of both rows 12 and 14 by the same support member rendering it necessary to remove both panels 15 (and the support member) if either one must be demounted.

Figure 4:
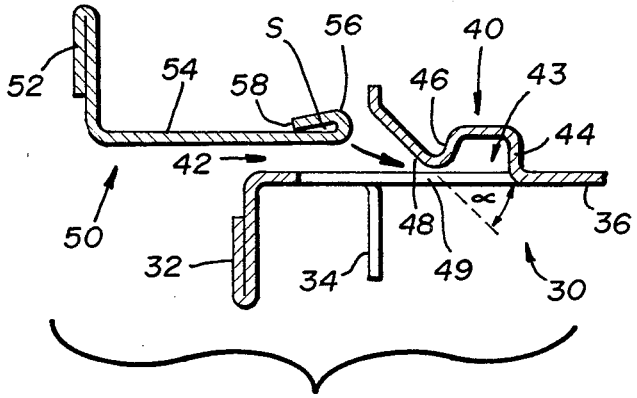
FIG. 4 is a fragmentary, enlarged sectional view taken generally along the line IV—IV of FIG. 3, an angle member having been added in position for assembly.
Figure 3:
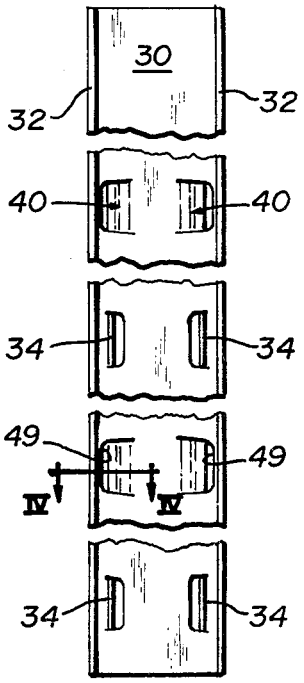
FIG. 3 is a fragmentary elevational view of the stud member shown in FIGS. 1 and 2, taken from the side opposite to that shown in FIG. 2.

Turning now to FIGS. 1–4, in accordance with one aspect of the invention, the support member comprises the stud member 30 and angle members 50 of which two are illustrated in this embodiment. The stud member comprises a web portion 36 bridging the space between the rows 12 and 14 and extending between the flanges 32. To accommodate the angle members 50 in a manner discussed hereafter, flanges 40 project from the side of web portion 36 which is opposite from the side from which flanges 32 project, to define a vertical slot or recess 42 opening outwardly towards joint 28. Slot 42 is spaced away from i.e., in between, both of the rows of panels so as to be free from interference by the panels, as will be apparent hereinafter. Flanges 40 are each characterized by a socket 43 (FIG. 4) formed by shaping the flange, as by roll-forming, so as to extend outwardly away from the web portion and generally perpendicular thereto, defining a stop surface 44. Thereafter, the flange extends generally parallel to the web portion, outwardly towards the joint, and thence back at 46 towards the web portion, completing the socket. Finally, to form a guide means for guiding the angle member into the socket, the flange terminates in a portion 48 which is inclined outwardly away from the web portion but towards the row of panels, the extension of portion 48 back to the web portion defining an angle "alpha," which is preferably about 45° (FIG. 4). This angle causes the angle member 50 to be readily guided into engagment with the flange 40, as will be seen.

As shown, the stud member 30 is roll-formed and the flanges 40 are lanced out of the web portion, leaving holes 49. Such a construction permits the flanges 40 to be formed as a series of three vertically spaced tabs (FIG. 2), preferably located 2 feet, 8 inches; four feet; and five feet, four inches; respectively, from the floor. However, if desired the flanges can extend the full length of the stud member, in which case the member 30 is preferably extruded.

In accordance with another aspect of the invention, angle member 50 is defined by a kerf-engaging leg 52, and a second leg 54 characterized by a beaded vertical edge 56. Preferably, to permit ready deliberate disengagement of the angle member from flange 40, the beaded edge is rounded slightly so as to provide some space, designated as S, FIG. 4, between the return and the main portion of the leg 54. Thus, for an angle member having a second leg thickness of about 0.027 inches, spacing S should be about 0.011 inches, defining a bead having an exterior width of about 0.065 inches. On the other hand, spacing S is not so great as to prevent the bead 56 from locking within the socket 43 against accidental release. That is, the extreme edge 58 of the return abuts against portion 46 of flange 40 when engaged within the socket, so as to require a deliberate, forceful separation of the angle member from flange 40. For this function, the closest approach of flange 40 to the web portion in the vicinity of opening 49 should be, in the case of the dimensions listed above, on the order of about 0.02 inches.

From the preceding, it will be readily apparent that assembly and disassembly of wall 11 proceeds in the following fashion. Panels 15 are assembled conventionally, with flanges 32 of stud member 30 interengaged in kerfs 25 thereof. Then, as shown in FIG. 1, angles 50 are first assembled to panels 16 with legs 52 interengaged in kerfs 25 of the panels. Both the panel and angle are then assembled to the wall by pressing leg 54 into slot 42, portion 48 of flange 40 guiding the beaded edge 56 into the socket 43. Portion 44 acts as a positive stop by extending across the path of the beaded edge, thereby resisting further inward movement of the angle member, and therefore preventing lipping of panel 16 with respect to panel 15. Edge 58 abuts against portion 46 of flange 40, resisting accidental displacement of the beaded edge 56 out of socket 43. However, deliberate separation is accomplished by forcefully removing the bottom edge of panel 16 from the plane of panel 15, and pulling the beaded edge gradually out by working the point of separation up the stud member. In this manner, panel 16 can be readily unlocked or demounted from stud member 30 without disturbing the latter or panels 15. Because slot 42 is between the rows of panels, the panels do not interfere with the flexibility of the flange 40, and therefore do not prevent the interlocking, or the unlocking of the angle leg 54 and the socket 43.

Any suitable material, preferably metal, can be utilized for the support member, in any gauge, and in any length. For example, 0.027 inch galvanized steel is particularly suitable if the stud member and angle members are roll-formed. Because engagement is accomplished vertically, anywhere along the stud member, the flanges 40 need not be carefully located and no cut-outs with careful tolerances are required in the angle members.

Figure 5:
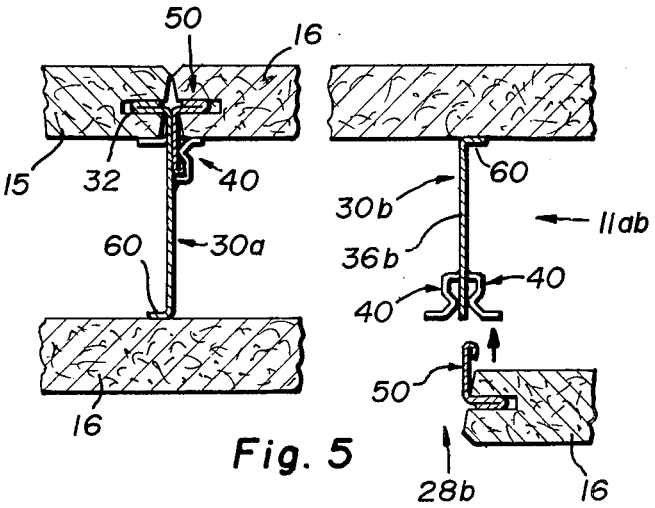
FIG. 5 is a fragmentary play view similar to FIG. 1 but illustrating two alternate embodiments of the invention.

Turning now to FIG. 5, there is illustrated a partition assembly featuring two other embodiments of the invention. Parts identical to those previously described bear the same numerals, while those different but similar to those previously described have appended to the same numerals the suffix *a* and *b*, respectively, for the two embodiments. Thus, a partition assembly 11ab comprises two spaced apart rows of panels 15 and 16, removably and demountably supported by stud members 30a and b, and angle members 50. Unlike the embodiment of FIGS. 1–4, each row is independently mounted with respect to the other in a manner similar to the construction shown in my aforesaid copending application. This can be accomplished by using either of stud members 30*a* or 30*b*, which are characterized by a flange 60 that laterally supports, but does not engage, the panels of the opposite row. In the case of stud member 30*a*, only one flange 40 is provided as in the previous embodiment, a single flange 32 being engaged with the kerf of panel 15. In the case of stud member 30*b*, two such flanges 40 are provided, albeit on opposite sides and in the vicinity of the panels of the same, rather than opposite, row. Stud member 30*b* thus releasibly engages two angles 50, only one of which is shown, rendering individually accessible, both adjacent panels 16 mounted at joint 28*b*, unlike the embodiments incorporating either stud member 30 or 30*a*. It will be appreciated that, in addition, stud member 30*b* can be modified (not shown) so as to have only one flange 40, the one projecting from the same side of the web portion 36b from which projects flange 60. In that event, a duplicate stud member 30*b* of like configuration (only one flange 40) is positioned back-to-back with the first stud member 30*b*, to releasibly mount the adjacent panel 16.

Figure 6:
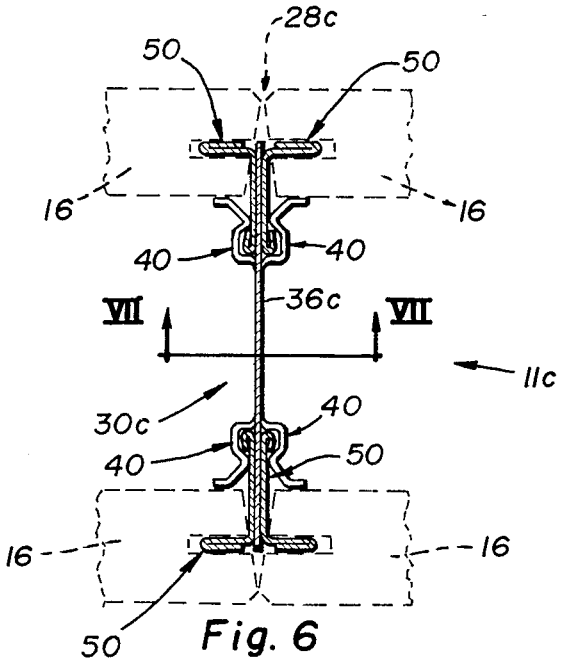
FIG. 6 is a fragmentary plan view in section of a support member constituting yet another embodiment of the invention.
Figure 7:
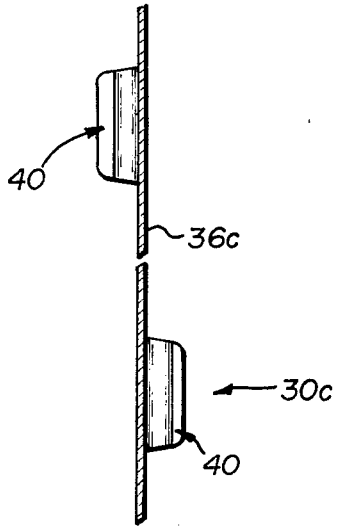
FIG. 7 is a fragmentary sectional view taken generally along the line VII—VII of FIG. 6, the angle members having been omitted for clarity.

FIGS. 6 and 7 illustrate still another embodiment of the invention, wherein all four partition panels at the joint and in both rows are releasibly mounted to the stud member by means of the angle members and socket flanges. Parts similar to those previously described bear the same reference numeral, to which the distinguishing suffix *c* has been added. Thus, wall 11c comprises panels 16 shown in phantom removably supported at each joint 28*c* by stud member 30*c* and four angle members 50 each releasibly engaged in the same manner as previous embodiments in a flange 40. Unlike the previous embodiments, stud member 30*c* comprises only a web portion 36*c* and four flanges 40 projecting from both sides of the web portion and from each edge thereof. If the stud member is roll-formed, flanges 40 are preferably lanced out of the web portion in alternative directions spaced along the length thereof, FIG. 7. The effect is to support and engage by stud member 30*c* all four panels at joint 28*c*, while permitting each of the four panels to be individually accessible and demountable without disturbing any of the other three panels, or the stud member.

Figure 8:
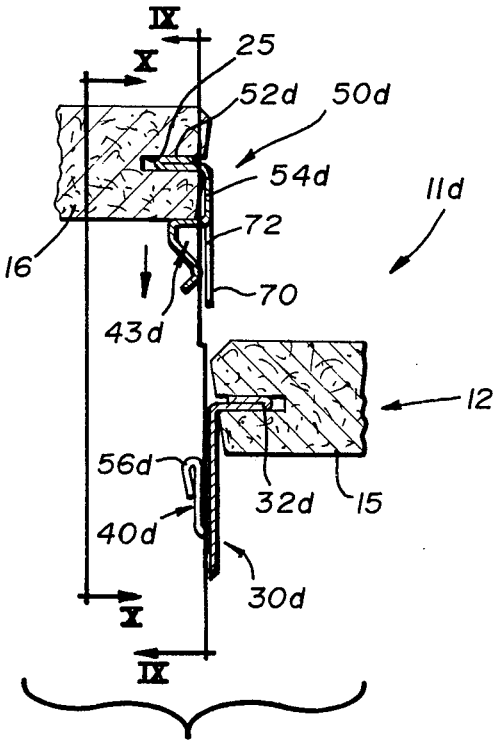
FIG. 8 is a fragmentary plan view similar to FIGS. 1 and 5 but illustrating still another embodiment of the invention.
Figure 9:
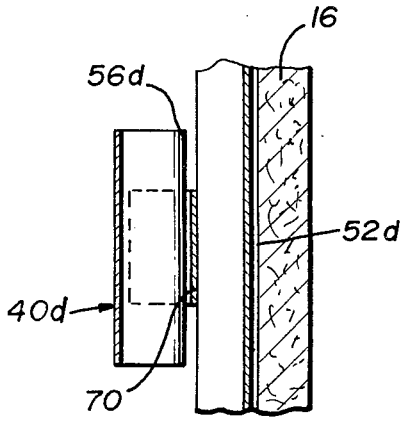
FIGS. 9 and 10 are fragmentary sectional views taken generally along the lines IX—IX and X—X, respectively, of FIG. 8.
Figure 10:
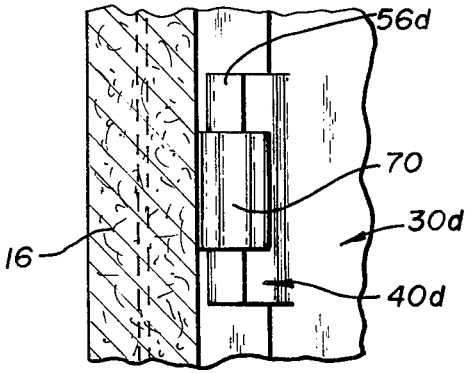

FIGS. 8–10 illustrate still another embodiment wherein the beaded edge and the socket have been reversed in position. Parts similar to those previously described bear the same reference numeral to which the distinguishing suffix *d* has been added. Thus, partition assembly 11d comprises panels 15 and 16 demountably supported in two opposed rows, only row 12 being shown, by a support member comprising a stud member and an angle member, as in embodiment shown in FIGS. 1–4, except that the beaded vertical edge 56*d* is formed on flange 40*d* of stud member 30*d*, while a socket 43*d* is formed by a separate flange or tab 70 projecting from leg 54*d* of angle member 50*d*. The kerfs 25 of panels 15 and 16 are engaged by flanges 32*d* and 52*d*, respectively, which are integral parts of the stud member and the angle member, respectively. As best seen in FIGS. 9 and 10, flanges 40d are considerably longer than tabs 70, so that they will cover the opening 72 left in the second leg 54*d* by the lancing out of the tabs 70. Alternatively, either or both stud member 30*d* or angle member 50*d* can be extruded, in which case flanges 40*d* or 70 can run the full length of their respective members. The opposite edge, not shown, of the support member may be of identical configuration as the edge shown.

It will be readily appreciated that each of the aforedescribed embodiments for the support members may be used in a single assembly, depending upon the conditions which are desired at each joint.

Although the invention has been described in connection with certain preferred embodiments, it is not intended that it be limited thereto. Rather, it is intended that the invention cover all embodiments, alternate arrangements, and equivalents as may be included within the scope of the following claims.

What is claimed is;

1. A demountable partition assembly comprising:

A. two opposed spaced-apart rows of partition panels having kerfs provided in their vertical edges, adjacent panels being arranged in edge-to-edge abutting relationship, B. a plurality of studs positioned intermediate said rows, each positioned at a joint between a pair of adjacent panels, each of said studs comprising:

1. a web portion extending across at least part of the space between the rows of panels,

2. panel supporting means engaging the kerfs of said pair of adjacent panels at said joint, at least one of said panel supporting means comprising:

a. at least one flange struck from and integral with said web portion extending a distance laterally from said web portion, a distance longitudinally thereto, and returning a distance toward said web to define a vertically extending socket between said flange and said web portion, said entire socket being positioned intermediate the inner wall surfaces of said two rows of partition panels, and spaced from the edge of said web portion, b. an L-shaped mounting member having a kerf-engaging leg disposed within the kerf of one of said adjacent panels, and a second leg having a margin folded over to provide detent means at its end releasibly disposed within said socket;

whereby said L-shaped mounting member-engaging panel may be demounted from the assembly without disturbing said stud member, said adjacent panel, or the panels of the opposite row.

2. A demountable partition assembly according to claim 1, wherein the web portion of each stud is provided with means for engaging the opposite row of panels.

3. The partition assembly as defined by claim 1, and further including on said flange, means for positively resisting inward movement of the mounting member with respect thereto.

4. The partition assembly as defined by claim 3, wherein a portion of said flange is bent generally perpendicularly to the web portion in releasable contact with the edge of said second leg.

5. The partition assembly as defined by claims 1, and further including a second flange integrally connected to and projecting from the side of said web portion opposite to the side from which said socket-forming flange projects.

6. The partition assembly as defined by claim 5, wherein said second flange is inserted within a kerfed edge of one of said panels.

7. The partition assembly as defined by claim 5, wherein said second flange is bent to form with said web portion a socket, and further including a second L-shaped mounting member having a first leg engaged within the kerf of a panel adjacent to said one mounting member-engaged panel, and a second leg having a beaded edge especially shaped to fit within said second socket.

8. The partition assembly as defined by claim 7, and further including two other pairs of socket-forming flanges and mounting members operatively connected to the row of panels opposite to the row of said one mounting member-engage panels, said other flanges being integrally connected to the web portion.

* * * * *